US010589542B2

(12) United States Patent
Yamazaki et al.

(10) Patent No.: US 10,589,542 B2
(45) Date of Patent: Mar. 17, 2020

(54) THERMAL TRANSFER PRINTER AND METHOD FOR CONTROLLING THE SAME

(71) Applicants: CITIZEN WATCH CO., LTD., Tokyo (JP); CITIZEN SYSTEMS JAPAN CO., LTD., Tokyo (JP)

(72) Inventors: Takeshi Yamazaki, Nagano (JP); Yutaka Inokuchi, Nagano (JP)

(73) Assignee: CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 16/318,324

(22) PCT Filed: Jan. 29, 2018

(86) PCT No.: PCT/JP2018/002772
§ 371 (c)(1),
(2) Date: Jan. 16, 2019

(87) PCT Pub. No.: WO2018/147115
PCT Pub. Date: Aug. 16, 2018

(65) Prior Publication Data

US 2019/0283448 A1 Sep. 19, 2019

(30) Foreign Application Priority Data

Feb. 9, 2017 (JP) ..... 2017-022081

(51) Int. Cl.
*B41J 2/35* (2006.01)
*B41J 2/325* (2006.01)
*B41J 2/355* (2006.01)

(52) U.S. Cl.
CPC ..... *B41J 2/35* (2013.01); *B41J 2/325* (2013.01); *B41J 2/355* (2013.01)

(58) Field of Classification Search
CPC ... B41J 2/35; B41J 2/355; B41J 2/3551; B41J 2/3553; B41J 2/3555; B41J 2/3556; B41J 2/3558; B41J 2/325
See application file for complete search history.

(56) References Cited

U.S. PATENT DOCUMENTS

2002/0039641 A1* 4/2002 Hayashi ..... B41M 7/0027 428/32.6
2004/0017458 A1 1/2004 Conwell
(Continued)

FOREIGN PATENT DOCUMENTS

CN 1951701 A 4/2007
CN 201800326 U 4/2011
(Continued)

OTHER PUBLICATIONS

EPO, Extended European Search Report for EP Application No. 18751237.1, dated Nov. 22, 2019.
(Continued)

*Primary Examiner* — Kristal Feggins

(57) ABSTRACT

In order to prevent degradation in print quality which can come from matter generated from an ink ribbon and adhering to a thermal head, the thermal transfer printer transports an ink ribbon which has characteristics such that the amount of matter generated from the ink ribbon by transfer and adhering to the thermal head has a peak at predetermined transfer energy and reduces in an energy range higher than the predetermined transfer energy with increase in transfer energy, transfers ink and protective material onto paper in this order from the ink ribbon on which the ink and the protective material are repeatedly arranged in a longitudinal direction thereof, and adjusts transfer energy for the protective material to a value within a predetermined range. The lower limit of the predetermined range is higher than the predetermined transfer energy and minimum energy at
(Continued)

which the protective material can be transferred, and is a value sufficient for transfer of the protective material to reduce matter having adhered to the thermal head since transfer of the ink. The upper limit of the predetermined range is lower than an energy value at which the protective material becomes mat and thereby glossiness of a protective layer on the paper formed from the protective material is lost.

5 Claims, 5 Drawing Sheets

(56) References Cited

U.S. PATENT DOCUMENTS

| | | | | |
|---|---|---|---|---|
| 2009/0035493 | A1* | 2/2009 | Murakami | B41J 2/325 428/32.77 |
| 2011/0262666 | A1 | 10/2011 | Choy et al. | |
| 2012/0056964 | A1* | 3/2012 | Matsuoka | B41J 2/325 347/213 |

FOREIGN PATENT DOCUMENTS

| | | | |
|---|---|---|---|
| CN | 102131650 | A | 7/2011 |
| CN | 102343733 | A | 2/2012 |
| CN | 103917374 | A | 7/2014 |
| JP | S55-53587 | A | 4/1980 |
| JP | S62-3990 | A | 1/1987 |
| JP | S63-159075 | A | 7/1988 |
| JP | H08-310093 | A | 11/1996 |
| JP | H09-202023 | A | 8/1997 |
| JP | H11-180058 | A | 7/1999 |
| JP | 2003-089274 | A | 3/2003 |
| JP | 2004-001299 | A | 1/2004 |
| JP | 2006-137004 | A | 6/2006 |
| JP | 2006-168306 | A | 6/2006 |
| JP | 2012-213883 | A | 11/2012 |
| JP | 2016-120705 | A | 7/2016 |
| WO | 2013/025746 | A1 | 2/2013 |

OTHER PUBLICATIONS

WIPO, International Search Report for PCT/JP2018/002772, dated Mar. 20, 2018.

China National Intellectual Property Administration, CN Office Action for Chinese Application No. 2018800016538, dated Sep. 29, 2019.

WIPO, Written Opinion for PCT Application No. PCT/JP2018/002772, dated Mar. 20, 2018.

* cited by examiner (A)

(B)

THERMAL TRANSFER PRINTER AND METHOD FOR CONTROLLING THE SAME

FIELD

The present invention relates to a thermal transfer printer and a method for controlling the same.

BACKGROUND

FIG. 5 is a plan view illustrating an ink ribbon 4 used in a thermal transfer printer. A thermal transfer printer capable of printing color images uses, for example, the ink ribbon 4 shown in FIG. 5, on which color ink regions of yellow Y, magenta M and cyan C and an overcoat OP region are repeatedly arranged in the same order in its longitudinal direction. While transporting the ink ribbon 4 in the direction of arrow A1, the printer sequentially transfers the color ink of yellow Y, magenta M and cyan C onto elongated receiver paper 10 to print an image I, and further transfers thereon the overcoat OP for enhancing light resistance and abrasion resistance, thereby forming a protective layer on the surface of the image I. After that, the printer transports the paper 10 in the direction of arrow A2 and cuts its leading edge, and further transports the paper 10 in the same direction and cuts the trailing edge of the image I, thus discharging the printed matter out of the printer.

During the transfer, the thermal transfer printer causes the thermal head to apply heat to the ink ribbon from the side opposite to the front side on which the ink layer (colorant layer) is provided. Of such ink ribbons, those which include a back layer made of a heat-resistant resin on the back side, which comes into contact with the thermal head, for enhancing heat resistance are known, as are those which include in the back layer a lubricant and an inorganic or organic particulate filler for reducing friction between the thermal head and the ink ribbon (see Patent Literature 1 and 2, for example).

FIG. 6 is a cross-sectional view of the ink ribbon 4. The ink ribbon 4 includes a base 41, a colorant primer layer 42, a colorant layer 43, an overcoat layer 44, a back primer layer 45 and a heat-resistant lubricating layer 46. The base 41 is placed at the center in the thickness direction of the ink ribbon 4. The colorant primer layer 42 is formed on one side of the base 41, while the back primer layer 45 is formed on the other side of the base 41. The colorant primer layer 42 corresponds to the front side which comes into contact with the paper 10, while the back primer layer 45 corresponds to the back side which comes into contact with the thermal head. The colorant layer 43 is a color ink (colorant) layer of yellow, magenta and cyan, and is formed on the colorant primer layer 42, together with the overcoat layer 44. The heat-resistant lubricating layer 46 is a layer containing a lubricant, a binder resin and a suitable filler, and is formed on the back primer layer 45.

CITATIONS LIST

Patent Literature

Patent Literature 1: Japanese Unexamined Patent Publication No. 2003-089274

Patent Literature 2: Japanese Unexamined Patent Publication No. 2012-213883

SUMMARY

As for the ink ribbon 4 in FIG. 6, the lubricant and other substances contained in the heat-resistant lubricating layer

46 (back layer) are melted by the heat of the thermal head, thereby reducing friction between the ink ribbon and the thermal head. However, the melted substances may recrystallize and accumulate on the surface of the thermal head under a certain temperature condition. Such adhering matter (ribbon waste) generated from the ink ribbon and accumulated on the thermal head may change the heat capacity of its adhering portion of the thermal head to result in printing unevenness and discoloration, and may cause the ribbon waste to damage the surface of the paper, which may impair the quality of printed matter. The use of a known ink ribbon which includes an inorganic filler in the heat-resistant lubricating layer for enhancing the cleaning ability of the thermal head reduces the occurrence of accumulation of the ribbon waste, but causes the inorganic filler to wear the thermal head, thereby reducing durability.

It is an object of the present invention to prevent degradation in print quality which can come from matter generated from an ink ribbon and adhering to a thermal head.

A thermal transfer printer is provided including a thermal head transferring ink and protective material onto paper from an ink ribbon on which the ink and the protective material are repeatedly arranged in a longitudinal direction thereof, a transporting unit transporting the ink ribbon which has characteristics such that the amount of matter generated from the ink ribbon by transfer and adhering to the thermal head has a peak at predetermined transfer energy and reduces in an energy range higher than the predetermined transfer energy with increase in transfer energy, and a control unit adjusting transfer energy for the protective material to a value within a predetermined range, the protective material being transferred by the thermal head after the ink. The lower limit of the predetermined range is higher than the predetermined transfer energy and minimum energy at which the protective material can be transferred, and is a value sufficient for transfer of the protective material to reduce matter having adhered to the thermal head since transfer of the ink. The upper limit of the predetermined range is lower than an energy value at which the protective material becomes mat and thereby glossiness of a protective layer on the paper formed from the protective material is lost.

Preferably, in the thermal transfer printer, the control unit further controls the thermal head to transfer the protective material at the same speed as or a lower speed than when the ink is transferred.

Preferably, the thermal transfer printer further includes a platen roller disposed so as to face the thermal head, the thermal head being pressed against the platen roller with the ink ribbon and the paper sandwiched therebetween. The thermal head includes heating elements disposed upstream of the position at which the thermal head is pressed against the platen roller as viewed in a transport direction of the ink ribbon.

Preferably, the glossiness is represented by a ratio of the intensity of reflected light to that of incident light incident on printed matter at an incident angle of 20 degrees, the printed matter being formed by transferring the ink and the protective material, and the upper limit of the predetermined range is lower than maximum energy at which the ratio is 90% of the maximum thereof.

Further, a method for controlling a thermal transfer printer transferring ink and protective material arranged on an ink ribbon onto paper with a thermal head is provided. The method includes the steps of transferring the ink onto paper, while transporting the ink ribbon which has characteristics such that the amount of matter generated from the ink ribbon by transfer and adhering to the thermal head has a peak at predetermined transfer energy and reduces in an energy range higher than the predetermined transfer energy with increase in transfer energy, and transferring, after the ink is transferred, the protective material onto the paper with transfer energy adjusted within a predetermined range, while transporting the ink ribbon. The lower limit of the predetermined range is higher than the predetermined transfer energy and minimum energy at which the protective material can be transferred, and is a value sufficient for transfer of the protective material to reduce matter having adhered to the thermal head since transfer of the ink. The upper limit of the predetermined range is lower than an energy value at which the protective material becomes mat and thereby glossiness of a protective layer on the paper formed from the protective material is lost.

The thermal transfer printer and the method for controlling the same can prevent degradation in print quality which can come from matter generated from the ink ribbon and adhering to the thermal head.

DESCRIPTION OF EMBODIMENTS

Hereinafter, with reference to the accompanying drawings, a thermal transfer printer and a method for controlling the same will be explained in detail. However, it should be noted that the present invention is not limited to the drawings or the embodiments described below.

Figure 1:
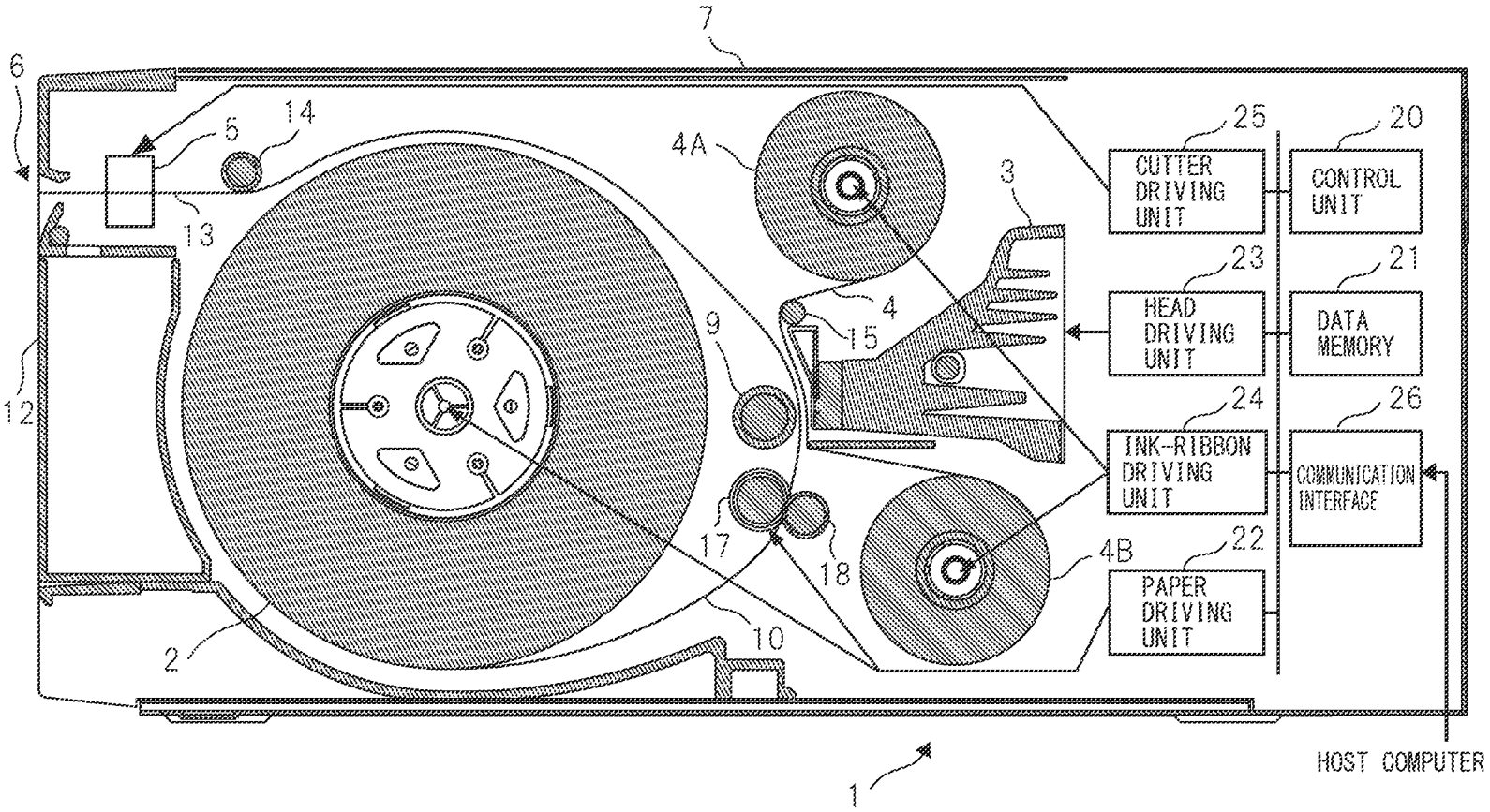
FIG. 1 is a cross-sectional view schematically illustrating the configuration of a printer 1.

FIG. 1 is a cross-sectional view schematically illustrating the configuration of a printer 1. In FIG. 1, of the components included in the printer 1, only those indispensable for explanation are shown, and the other components are omitted from the illustration.

The major components of the printer 1 include a rolled paper holder 2, a head 3, a ribbon supply roller 4A, a ribbon take-up roller 4B, a cutting unit 5, a platen roller 9, an exit roller 14, a ribbon guide roller 15, a grip roller 17 and a pinch roller 18. These components are disposed in a cabinet 7. The printer 1 further includes a control unit 20, a data memory 21, a paper driving unit 22, a head driving unit 23, an ink-ribbon driving unit 24, a cutter driving unit 25 and a communication interface 26.

The printer 1 is a thermal transfer printer which prints an image by transferring ink carried on an ink ribbon 4 onto rolled paper 10. The printer 1 sequentially transfers a plurality of colors, such as yellow, magenta and cyan, and overcoat from the ink ribbon 4 onto the same area on the paper 10 by moving the paper 10 back and forth relative to the head 3. The printed paper 10 is cut by the cutting unit 5 and discharged out of the printer 1 through an exit port 6 provided in the front face 12 of the printer 1. Hereinafter, printing an image may also be referred to as "image formation."

The rolled paper holder 2 holds thereon the paper 10 wound into a roll. The material of the paper 10 is not specifically limited, as long as it is usable on the thermal transfer printer. The rolled paper holder 2 is driven by the paper driving unit 22 in the forward or backward direction, thereby rotating around the center axis thereof. The rotation of the rolled paper holder 2 in the forward direction causes the paper 10 to pass between the head 3 and the platen roller 9 and to be transported toward the exit port 6. The rotation of the rolled paper holder 2 in the backward direction rewinds the paper 10 onto the rolled paper holder 2.

The ribbon supply roller 4A and the ribbon take-up roller 4B hold the ink ribbon 4 thereon, and are driven by the ink-ribbon driving unit 24 to rotate around their center axes. By this driving, the ink ribbon 4 is unwound from the ribbon supply roller 4A, is transported via the ribbon guide roller 15 and passed between the head 3 and the platen roller 9, and is wound on the ribbon take-up roller 4B.

The ink ribbon 4 is a belt-like sheet on which color ink regions of yellow, magenta and cyan and an overcoat region, for example, are repeatedly arranged in the same order in its longitudinal direction. The overcoat is protective material for enhancing light resistance and abrasion resistance of printed matter. The ink ribbon 4 is available in various sizes, the size of each ink region being, for example, 6×4 inches or 6×8 inches; and thus the printer 1 is equipped with an ink ribbon 4 matching the image size to be formed. The number of ink colors of the ink ribbon 4 is not limited to three, and may be one or two, or more than three.

The head 3 is disposed so as to face the platen roller 9, and is movable relative to the platen roller 9. During image formation, the head 3 is pressed against the platen roller 9 with the ink ribbon 4 and the paper 10 sandwiched therebetween, and heats internal heating elements to sequentially transfer the ink of each color and the overcoat from the ink ribbon 4 onto the same area on the paper 10, thereby printing an image on the paper. This transfer is repeated for each region of the ink ribbon 4, while the ink ribbon 4 is being wound. Since the overcoat is used for forming a protective layer on the surface of the printed matter, it is transferred last after the color ink. The head 3 includes a mechanism matching the type of the thermal transfer printer, such as a dye-sublimation printer or a thermal wax printer.

The grip roller 17 and the pinch roller 18 transport the paper 10 by sandwiching it therebetween. The grip roller 17 is driven by the paper driving unit 22 to rotate either in the forward direction in which the paper 10 is fed out or in the backward direction in which it is rewound. The pinch roller 18 is rotated by being driven by the grip roller 17. When transporting the paper 10, the pinch roller 18 is pressed against the grip roller 17 to hold the paper 10 between it and the grip roller 17. When not transporting the paper 10, the pinch roller 18 is separated from the grip roller 17 to release the paper 10.

The paper 10 unwound from the rolled paper holder 2 and passed between the head 3 and the platen roller 9 is transported by the exit roller 14 along an exit path 13 toward the exit port 6. The cutting unit 5 cuts the paper 10 whose leading edge has passed the exit path 13 and fed out of the printer 1, at a position before the exit port 6. The cutting unit 5 is located in the exit path 13 at a position just before the exit port 6, and is driven by the cutter driving unit 25.

The control unit 20 is constructed from a microcomputer including a CPU and a memory, and controls the entire operation of the printer 1. The data memory 21 is a storage area for storing image data received from a host computer via the communication interface 26. The paper driving unit 22 is a motor for driving the grip roller 17 and the rolled paper holder 2, and drives them to rotate either in the direction in which the paper 10 is fed out or in the direction in which it is rewound. The head driving unit 23 drives the head 3 based on the image data to print an image on the paper 10.

The ink ribbon driving unit 24 is a motor for driving the ribbon supply roller 4A and the ribbon take-up roller 4B, and drives them to rotate either in the direction in which the ink ribbon 4 is wound on the ribbon take-up roller 4B or in the direction in which the ink ribbon 4 is rewound on the ribbon supply roller 4A. The ribbon supply roller 4A, the ribbon take-up roller 4B and the ink-ribbon driving unit 24 are an example of the transporting unit transporting the ink ribbon. The cutter driving unit 25 is a motor for driving the cutting unit 5. The communication interface 26 receives print image data from the host computer via a communication cable, for example.

Figure 2:
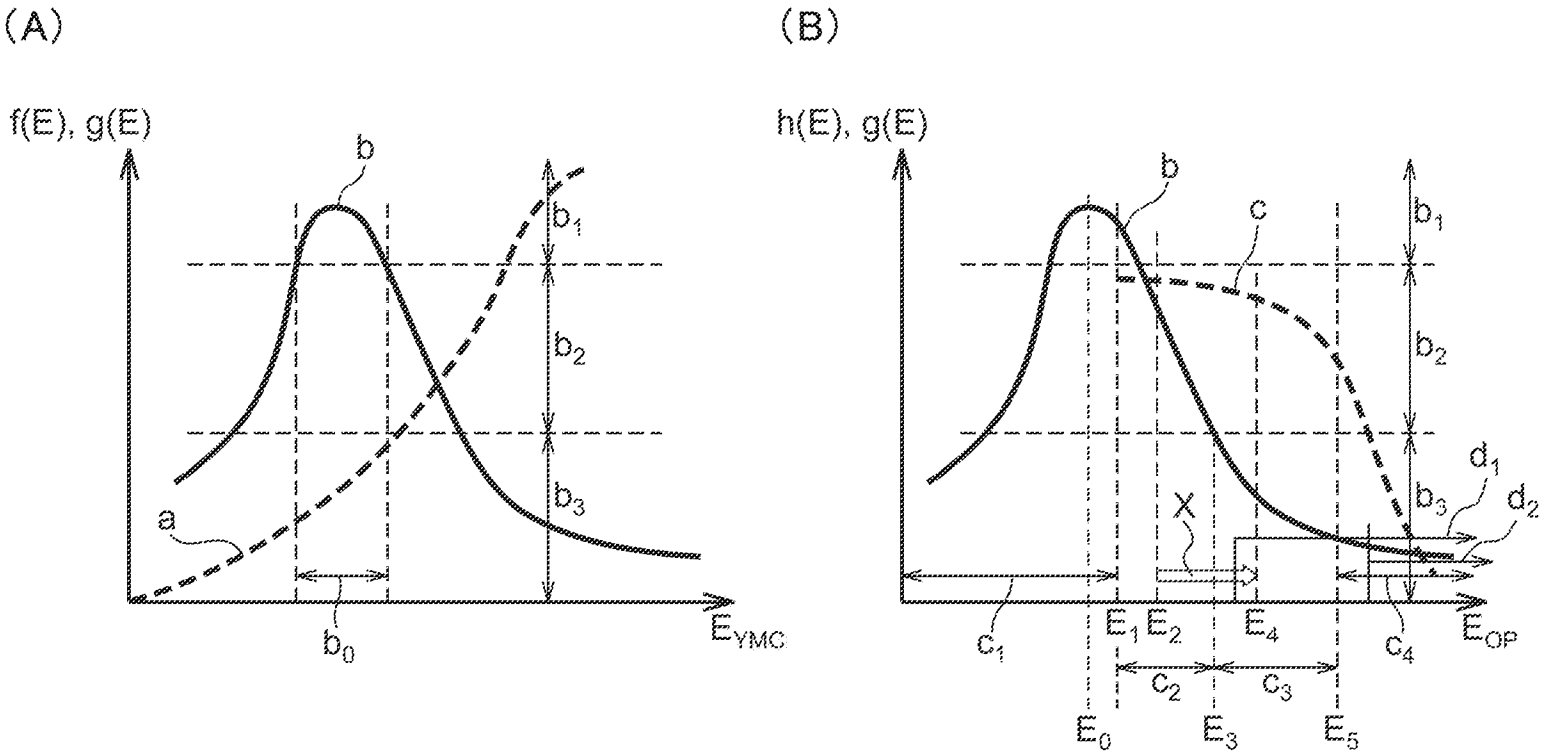
FIGS. 2(A) and (B) are graphs showing the relationship between the transfer energy applied to the ink ribbon, the optical density of transferred yellow Y, magenta M or cyan C, the glossiness of transferred overcoat OP, and the amount of ribbon waste adhering to the thermal head.

FIGS. 2(A) and 2(B) are graphs showing the relationship between the transfer energy applied to the ink ribbon, the optical density of transferred yellow Y, magenta M or cyan C, the glossiness of transferred overcoat OP, and the amount of ribbon waste adhering to the thermal head.

The abscissa of FIG. 2(A) represents the transfer energy $E_{YMC}$ for yellow Y, magenta M or cyan C, and that of FIG. 2(B) represents the transfer energy $E_{OP}$ for overcoat OP. The curve a in FIG. 2(A) is a graph showing the optical density f(E) of yellow, magenta or cyan of printed matter corresponding to the transfer energy $E_{YMC}$, and the curve c in FIG. 2(B) is a graph showing the glossiness h(E) of the overcoat of printed matter corresponding to the transfer energy $E_{OP}$. The curves b in FIGS. 2(A) and 2(B) are graphs showing the amount of ribbon waste g(E) (generated during one transfer operation) corresponding to the transfer energy $E_{YMC}$ or $E_{OP}$. The ordinate of FIG. 2(A) represents the optical density f(E) and the amount of ribbon waste g(E), and that of FIG. 2(B) represents the glossiness h(E) and the amount of ribbon waste g(E). The abscissa of each graph increases in the rightward direction, while the ordinate thereof increases in the upward direction.

The curve a indicates that as the transfer energy $E_{YMC}$ increases, the optical density f(E) also increases. The curves b indicate that the amount of ribbon waste g(E) reaches its peak at predetermined transfer energy $E_0$ (more specifically, when an image having predetermined optical density is printed). The relationship between the transfer energy and the amount of ribbon waste is the same between the transfer of yellow, magenta or cyan and that of the overcoat, and thus the curves b in FIGS. 2(A) and 2(B) have the same shape.

Arrows $b_1$ to $b_3$ in the graphs indicate ranges where the amount of ribbon waste g(E) is large, medium and small, respectively. If image formation is continued at transfer energy in the range of large g(E) (arrow $b_1$), the amount of ribbon waste adhering to the thermal head increases. Arrow $b_0$ in FIG. 2(A) indicates the energy interval where the amount of adhering ribbon waste increases when image formation is continued. As described above, accumulated ribbon waste on the thermal head may result in printing unevenness and damage on the paper surface. If image formation is continued at transfer energy in the range of medium g(E) (arrow $b_2$), the amount of adhering ribbon waste does not change. If image formation is continued at transfer energy in the range of small g(E) (arrow $b_3$), the amount of adhering ribbon waste reduces. In this case, the amount reduces because the ribbon waste having once adhered to the thermal head melts during the subsequent transfer or it adheres to the ink ribbon and is carried away.

As for the overcoat, the curve c indicates that as the transfer energy increases, the glossiness h(E) reduces. If the transfer energy is too low, the overcoat is not transferred onto the paper (defective transfer). If the transfer energy is too high, the overcoat becomes mat and thereby the glossiness of the protective layer is lost. Arrows $c_1$ and $c_4$ in FIG. 2(B) indicate the energy interval where defective transfer occurs, and the energy interval where the overcoat becomes mat, respectively. Symbols $E_1$ and $E_5$ in FIG. 2(B) indicate the minimum transfer energy at which the overcoat can be transferred, and the maximum transfer energy at which the overcoat does not become mat, respectively.

Arrow $c_2$ in FIG. 2(B) indicates the energy interval where the overcoat can be transferred but the amount of ribbon waste adhering to the thermal head does not reduce. Arrow $c_3$ in FIG. 2(B) indicates the energy interval where this amount reduces. Symbol $E_3$ corresponds to the boundary value between the intervals $c_2$ and $c_3$, and indicates the minimum transfer energy for the overcoat at which the amount of ribbon waste adhering to the thermal head reduces when image formation (transfer) is continued. In other words, $c_3$ indicates the energy range where the ribbon waste having adhered to the thermal head since transfer of yellow, magenta and cyan is reduced by transferring the overcoat, and $E_3$ corresponds to the minimum transfer energy of that range.

It is conceivable that most of the commercially available ink ribbons for thermal transfer printers exhibit the same characteristics as indicated by curves a to c in FIGS. 2(A) and 2(B). More specifically, they have characteristics such that the amount of matter generated from the ink ribbon by transfer and adhering to the thermal head has a peak at predetermined transfer energy and reduces in an energy range higher than the predetermined transfer energy with increase in transfer energy. Further, the glossiness of the overcoat reduces as the transfer energy increases. Hereinafter, a description is given of how to control the transfer energy when an ink ribbon having such characteristics is used in the printer 1.

When yellow, magenta or cyan is transferred, the ribbon waste may be accumulated on the thermal head depending on images, since the optical density of the colors and the heat quantity of the thermal head depend on the output image. However, when the overcoat is transferred, the transfer energy (heat quantity of the thermal head) is adjustable, regardless of the image, within the range between the minimum energy $E_1$ at which defective transfer does not occur and the maximum energy $E_5$ at which the overcoat does not become mat. Thus, in the printer 1, the transfer energy $E_{OP}$ for the overcoat is set so that the ribbon waste having adhered to the thermal head since transfer of yellow, magenta or cyan is reduced by the subsequent transfer of the overcoat.

In general, the transfer energy $E_{OP}$ is set as low as possible within the range where defective transfer does not occur (more specifically, at a value higher than $E_1$), in order to prevent overheating and obtain glossiness. For example, the transfer energy $E_{OP}$ of ordinary thermal transfer printers is a value $E_2$ in the interval $c_2$, whose lowest endpoint is $E_1$, in the graph of FIG. 2(B). However, transfer energy in the interval $c_2$ does not cause the ribbon waste adhering to the thermal head to reduce as described above, and thus does not allow the adhering ribbon waste to be removed. Further, as can be seen from the comparison between the curves b and c in FIG. 2(B), the amount of ribbon waste greatly reduces before the glossiness greatly reduces with increase in transfer energy $E_{OP}$ in the interval $c_3$, whose energy is higher than that of the interval $c_2$. Accordingly, in the printer 1, the transfer energy $E_{OP}$ is raised from the set value $E_2$ for ordinary thermal transfer printers to a value $E_4$ in the interval $c_3$, as indicated by arrow X in FIG. 2(B).

During the transfer of the overcoat, the control unit 20 of the printer 1 raises the temperature of the heating elements in the head 3 and slows the transporting speed of the ink ribbon 4, as compared to ordinary thermal transfer printers, thereby adjusting the transfer energy $E_{OP}$ applied to the ink ribbon 4 by the head 3 to a value $E_4$ in the range indicated by arrow $c_3$ in FIG. 2(B). Summing up the above-described energy values for transferring the overcoat, the magnitude relationship $E_0<E_1<E_2<E_3<E_4<E_5$ holds between the value $E_0$ at which the amount of ribbon waste reaches its peak, the minimum $E_1$ in the range where the overcoat can be transferred, the set value $E_2$ for ordinary thermal transfer printers, the minimum $E_3$ in the range where the amount of adhering ribbon waste reduces when image formation is continued, the set value $E_4$ for the printer 1, and the maximum $E_5$ in the range where the overcoat does not become mat. However, the magnitude relationship between $E_0$ and $E_1$ may be reversed for some ink ribbons.

Accordingly, the set value $E_4$ is higher than the energy $E_0$ corresponding to the peak of the amount of ribbon waste and higher than the minimum energy $E_1$ at which the overcoat can be transferred, and is a value sufficient for transfer of the overcoat to reduce matter having adhered to the head 3 since transfer of the ink of each color (more specifically, a value higher than $E_3$). The set value $E_4$ is a value lower than the energy $E_5$ at which the overcoat becomes mat. The set value $E_4$ may also be energy at which the amount of adhering ribbon waste reduces when gray and overcoat are repeatedly transferred, since the transfer energy at which the amount of ribbon waste reaches its peak is substantially the same for all the colors and equal mixture of yellow, magenta and cyan leads to gray.

In the printer 1, since the transfer energy for the overcoat is set as described above, the ribbon waste having adhered to the head 3 since transfer of color ink reduces during the transfer of the overcoat for each sheet of printed matter, even when images which are likely to cause ribbon waste are repeatedly formed. Therefore, defective printing (printing unevenness and damage) caused by accumulated ribbon waste is unlikely to occur in the printer 1. The printer 1 can prevent degradation in print quality which can come from matter generated from the ink ribbon and adhering to the thermal head, even when an ink ribbon which does not wear the thermal head is used.

The accumulation of the ribbon waste can be prevented by setting the transfer energy $E_{OP}$ for the overcoat at a value in the range $c_3$. However, since the glossiness of the protective layer decreases with increase in $E_{OP}$, the actual set value $E_4$ is determined in view of the glossiness. In particular, if the printer 1 prints a photograph, printed matter should have high glossiness; and thus, the control unit 20 preferably sets the value $E_4$ within the range $c_3$ so that the glossiness may be maintained at a high value of about 80% to 90% as compared to the case where the transfer energy $E_{OP}$ is set at $E_2$. Hereinafter, a further description is given of the upper limit of the transfer energy $E_{OP}$ in terms of the glossiness.

Figure 3:
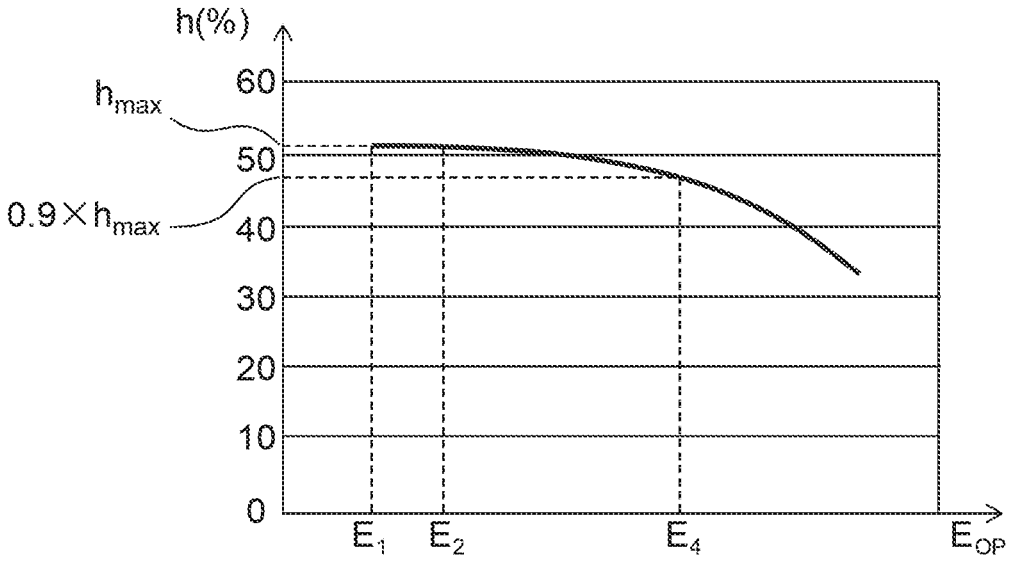
FIG. 3 is a graph showing the relationship between the transfer energy for the overcoat and its glossiness.

FIG. 3 is a graph showing the relationship between the transfer energy for the overcoat and its glossiness. The abscissa and ordinate of FIG. 3 represent the transfer energy $E_{OP}$ and the glossiness h of transferred overcoat, respectively. The value of glossiness h in FIG. 3 is a ratio of the intensity of reflected light to that of incident light incident on a printed surface of a solid black image at an incident angle of 20 degrees with respect to the normal direction thereof. The glossiness h has a value slightly larger than 50% when the transfer energy $E_{OP}$ is set at the minimum $E_1$ in the range where defective transfer does not occur; and the glossiness reduces from that value as $E_{OP}$ increases. When $E_{OP}$ is set at $E_4$ shown in FIG. 3, the glossiness h is substantially 90% of the maximum $h_{max}$ and is not substantially reduced as compared to the value corresponding to $E_1$. Thus, it is preferred that the set value $E_4$ for the printer 1 be a value lower than the maximum energy at which the above-defined glossiness value is 90% of the glossiness $h_{max}$ corresponding to $E_1$.

In general, the transfer speed of the overcoat is set at a value higher than that of the color ink, in order to output printed matter quickly. Transfer at high energy may cause creases in the ink ribbon, which is more likely to occur as the transfer speed increases. Arrows $d_1$ and $d_2$ in FIG. 2(B) indicate the energy intervals where the creases may occur in the ink ribbon when the transfer speed of the overcoat is relatively fast and slow, respectively. Since the value $E_4$ in FIG. 2(B) is included in the interval of arrow $d_1$, setting the transfer speed of the overcoat faster than that of the color ink and setting the transfer energy $E_{OP}$ at $E_4$, which is larger than $E_2$, may cause creases in the ink ribbon.

Thus, the control unit 20 of the printer 1 preferably controls the driving of the head 3 and the transportation of the ink ribbon 4 so that the overcoat is transferred at the same speed as or a lower speed than when yellow, magenta and cyan is printed. In other words, the control unit 20 preferably controls them so that the length of time during which the head 3 heats the overcoat region is the same as or longer than that of time during which the head 3 heats one of the color ink regions. Slowing the transfer speed of the overcoat reduces the occurrence of creases in the ink ribbon, since the creases do not occur unless the transfer energy $E_{OP}$ is set at a value in the range $d_2$, whose energy is higher than that of the interval $d_1$.

Figure 4:
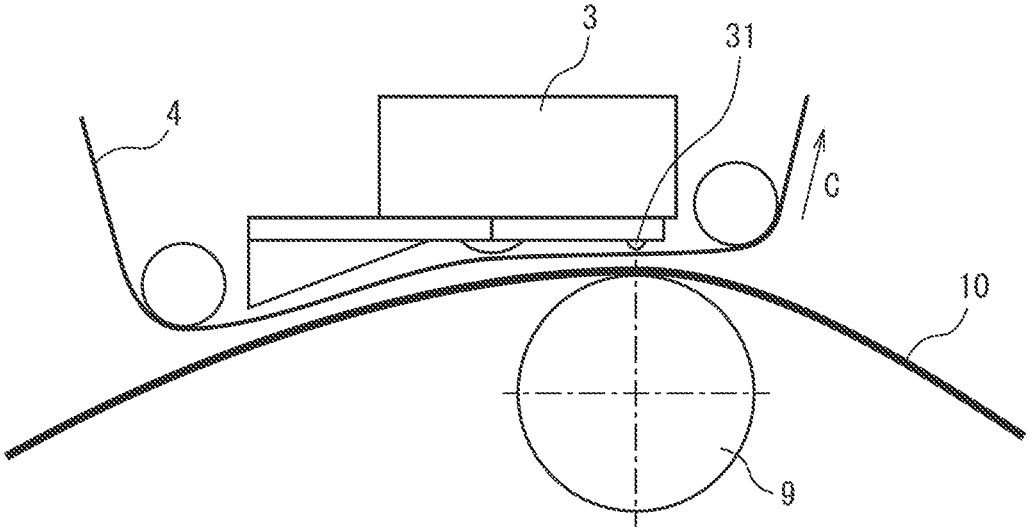
FIGS. 4(A) and (B) are diagrams for explaining the positional relationship between the head 3 and the platen roller 9.
Figure 4:
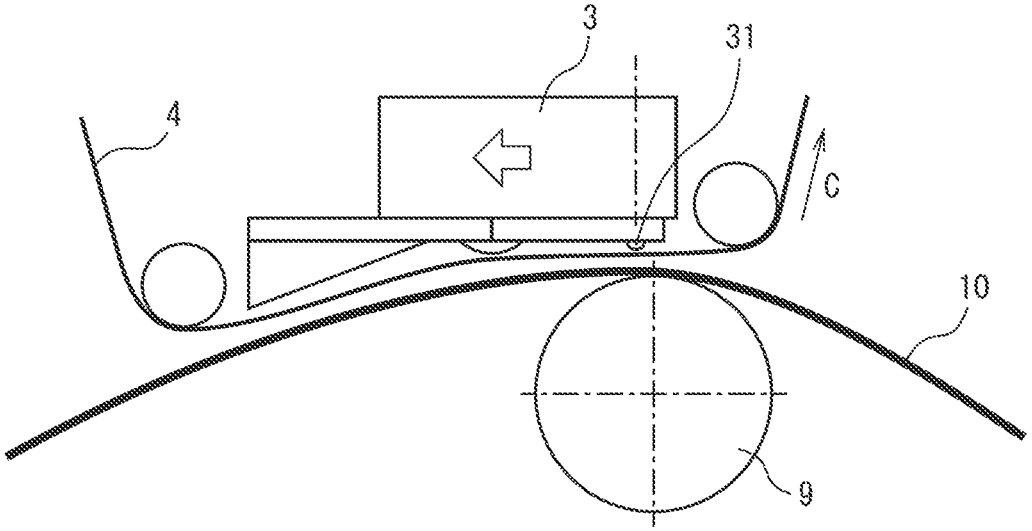
Figure 5:
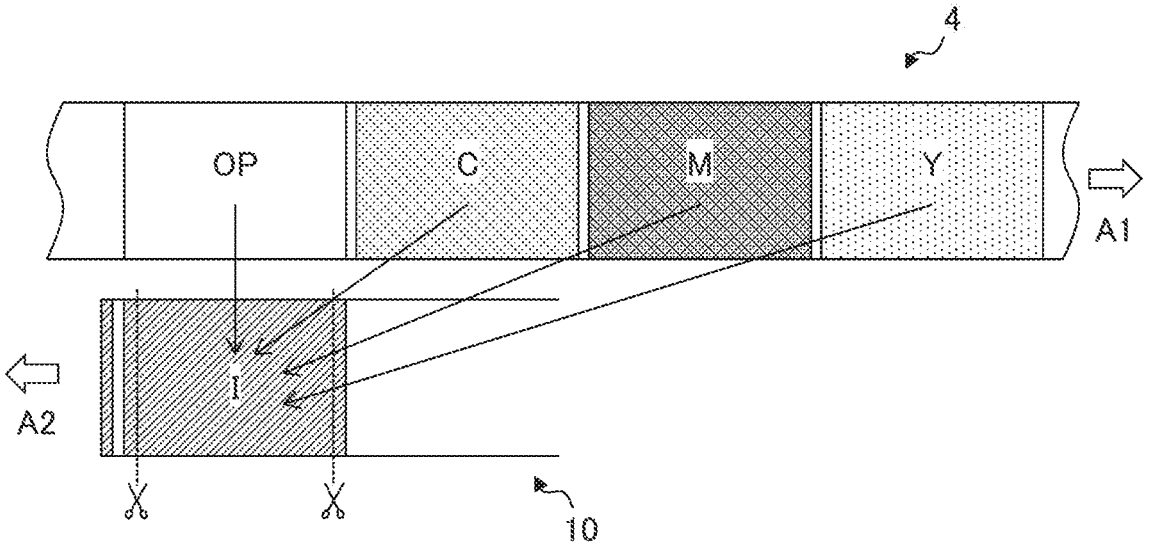
FIG. 5 is a plan view illustrating an ink ribbon 4 used in a thermal transfer printer.
Figure 6:
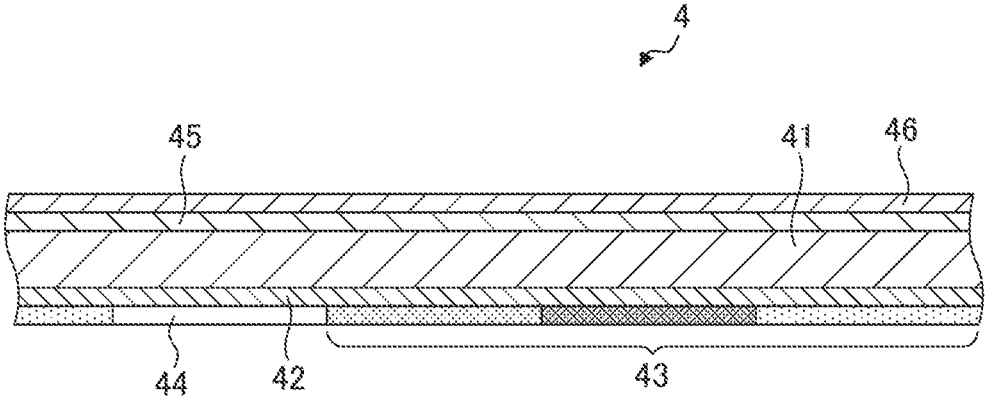
FIG. 6 is a cross-sectional view of the ink ribbon 4.

FIGS. 4(A) and 4(B) are diagrams for explaining the positional relationship between the head 3 and the platen roller 9. In these figures, the ink ribbon 4 is transported and wound in the right direction indicated by arrow C. As shown in FIG. 4(A), in ordinary thermal transfer printers, the heating elements (glaze) 31 of the head 3 are disposed immediately above the center of the platen roller 9. At this position, the head 3 is pressed against the platen roller 9 with the ink ribbon 4 and the paper 10 sandwiched therebetween. However, disposing the heating elements 31 upstream of the center of the platen roller 9 as viewed in the transport direction of the ink ribbon 4 as shown in FIG. 4(B) (left side in the figure) allows the ribbon waste to adhere to the ink ribbon and to be carried away, which makes the ribbon waste be less easily accumulated on the head 3.

Thus, in the printer 1, the position on the head 3 where the heating elements 31 are mounted may be upstream of the position at which the head 3 is pressed against the platen roller 9 as viewed in the transport direction of the ink ribbon 4, as shown in FIG. 4(B). The combination of the above-described control of the transfer energy $E_{OP}$ and mechanism in which the heating elements 31 are thus shifted allows for further reduction in the amount of ribbon waste adhering to the head 3. Contrary to FIG. 4(B), if the position of the heating elements 31 are downstream in the transport direction of the ink ribbon 4 (right side in the figure), the transfer may degrade the paper as if it were scorched. Thus, it is preferred to shift the heating elements 31 to the upstream side (in the direction opposite to arrow C).

The invention claimed is:

1. A thermal transfer printer comprising:

a thermal head transferring ink and protective material onto paper from an ink ribbon on which the ink and the protective material are repeatedly arranged in a longitudinal direction thereof;

a transporting unit transporting the ink ribbon which has characteristics such that the amount of matter generated from the ink ribbon by transfer and adhering to the thermal head has a peak at predetermined transfer energy and reduces in an energy range higher than the predetermined transfer energy with increase in transfer energy; and a control unit adjusting transfer energy for the protective material to a value within a predetermined range, the protective material being transferred by the thermal head after the ink, wherein the lower limit of the predetermined range is higher than the predetermined transfer energy and minimum energy at which the protective material can be transferred, and is a value sufficient for transfer of the protective material to reduce matter having adhered to the thermal head since transfer of the ink, and the upper limit of the predetermined range is lower than an energy value at which the protective material becomes mat and thereby glossiness of a protective layer on the paper formed from the protective material is lost.

2. The thermal transfer printer according to claim 1, wherein the control unit further controls the thermal head to transfer the protective material at the same speed as or a lower speed than when the ink is transferred.

3. The thermal transfer printer according to claim 1, further comprising a platen roller disposed so as to face the thermal head, the thermal head being pressed against the platen roller with the ink ribbon and the paper sandwiched therebetween, wherein the thermal head includes heating elements disposed upstream of the position at which the thermal head is pressed against the platen roller as viewed in a transport direction of the ink ribbon.

4. The thermal transfer printer according to claim 1, wherein the glossiness is represented by a ratio of the intensity of reflected light to that of incident light incident on printed matter at an incident angle of 20 degrees, the printed matter being formed by transferring the ink and the protective material, and the upper limit of the predetermined range is lower than maximum energy at which the ratio is 90% of the maximum thereof.

5. A method for controlling a thermal transfer printer transferring ink and protective material arranged on an ink ribbon onto paper with a thermal head, the method comprising the steps of:

transferring the ink onto paper, while transporting the ink ribbon which has characteristics such that the amount of matter generated from the ink ribbon by transfer and adhering to the thermal head has a peak at predetermined transfer energy and reduces in an energy range higher than the predetermined transfer energy with increase in transfer energy; and transferring, after the ink is transferred, the protective material onto the paper with transfer energy adjusted within a predetermined range, while transporting the ink ribbon, wherein the lower limit of the predetermined range is higher than the predetermined transfer energy and minimum energy at which the protective material can be transferred, and is a value sufficient for transfer of the protective material to reduce matter having adhered to the thermal head since transfer of the ink, and the upper limit of the predetermined range is lower than an energy value at which the protective material becomes mat and thereby glossiness of a protective layer on the paper formed from the protective material is lost.

* * * * *